US006027591A

United States Patent [19]

O'Dwyer

[11] Patent Number: 6,027,591

[45] Date of Patent: Feb. 22, 2000

[54] SINGLE FACE SPLICER AND METHOD OF USING THE SAME

[75] Inventor: John O'Dwyer, Lynn, Mass.

[73] Assignee: United Container Machinery, Inc., Glen Arm, Md.

[21] Appl. No.: 08/925,374

[22] Filed: Sep. 8, 1997

Related U.S. Application Data

[60] Provisional application No. 60/026,131, Sep. 16, 1996.

[51] Int. Cl.[7] ..... B65H 21/00; B31F 5/00

[52] U.S. Cl. ..... 156/157; 156/210; 156/361; 156/462; 156/470; 156/504

[58] Field of Search ..... 156/157, 210, 156/462, 470, 504, 361

[56] References Cited

U.S. PATENT DOCUMENTS

| | | | |
|---|---|---|---|
| 2,844,186 | 9/1958 | Sunnen, Jr. | 154/42.2 |
| 3,089,661 | 5/1963 | Phillips, Jr. et al. | 242/58.4 |
| 3,227,594 | 1/1966 | Ryan | 156/159 |
| 3,305,189 | 2/1967 | Butler, Jr. et al. | 242/58.1 |
| 3,414,208 | 12/1968 | Butler, Jr. et al. | 242/58.1 |
| 3,858,819 | 1/1975 | Butler, Jr. | 242/58.3 |
| 4,121,964 | 10/1978 | Berkowitz et al. | 156/507 |
| 4,222,533 | 9/1980 | Pongracz | 242/58.3 |
| 4,576,663 | 3/1986 | Bory | 156/361 |
| 4,769,098 | 9/1988 | Cederholm et al. | 156/159 |
| 4,923,546 | 5/1990 | Wheeler et al. | 156/159 |
| 5,045,134 | 9/1991 | Schenker et al. | 156/64 |
| 5,064,488 | 11/1991 | Dickey | 156/159 |
| 5,127,981 | 7/1992 | Straub et al. | 156/519 |
| 5,171,396 | 12/1992 | Rank et al. | 156/502 |
| 5,190,234 | 3/1993 | Ezekiel | 242/58.1 |
| 5,252,170 | 10/1993 | Schaupp | 156/350 |
| 5,253,819 | 10/1993 | Butler, Jr. | 242/58.3 |
| 5,288,361 | 2/1994 | Konno | 156/353 |
| 5,360,502 | 11/1994 | Andersson | 156/159 |
| 5,437,749 | 8/1995 | Pipkorn et al. | 156/64 |
| 5,474,252 | 12/1995 | Schmid | 242/554.2 |
| 5,487,805 | 1/1996 | Boriani et al. | 156/159 |
| 5,639,338 | 6/1997 | Beckamnn | 156/504 |
| 5,679,195 | 10/1997 | O'Dwyer et al. | 156/159 |
| 5,698,060 | 12/1997 | Long | 156/304.3 |

FOREIGN PATENT DOCUMENTS

| | | |
|---|---|---|
| 61-27860 | 2/1986 | Japan . |
| 62-21656 | 1/1987 | Japan . |
| WO9116255 | 10/1991 | WIPO . |

*Primary Examiner*—Richard Crispino
*Assistant Examiner*—Robert R. Koehler
*Attorney, Agent, or Firm*—Biebel & French

[57] ABSTRACT

A single face splicer for creating a splice between a running web from a first source of single face material and a ready web from a second source of single face material to provide an uninterrupted supply of single face material to a double backer system in the manufacture of corrugated cardboard. The splicer includes an upper and lower bridge positioned above the first and second sources of single face material, and a splice head adjacent the upper bridge for creating the splice between the running web and the ready web. A drive system draws the running web through the splice head at an output speed which is greater than the speed at which the double backer system draws the running web from the splicer. The running web is deposited on an upper bridge supply belt which rotates at a speed which is slower than the output speed thereby causing the running web to accumulate on the upper bridge supply belt. As the splice is made, the double backer system draws from the accumulated storage on the upper bridge supply belt. To allow for pre-acceleration of the first and second supplies of single face material, the running or ready webs is deposited onto a first or second lower bridge supply belt which is rotating at a speed which is slower than the output speed of the first or second supply. An accumulation of running or ready web is created on the first or second lower bridge supply belt which allows for pre-acceleration of the first or second supply prior to the initiation of a splice.

28 Claims, 7 Drawing Sheets

SINGLE FACE SPLICER AND METHOD OF USING THE SAME

CROSS REFERENCE TO RELATED APPLICATIONS

The present application claims priority to U.S. Provisional Application Ser. No. 60/026,131, filed Sep. 16, 1996, the teachings of which are incorporated herein by reference.

FIELD OF THE INVENTION

The present invention relates to a web splicing apparatus, and, more particularly, to an apparatus which automatically splices single face web material for making corrugated cardboard.

BACKGROUND OF THE INVENTION

In the manufacture of corrugated cardboard, "single face" material comprising a fluted web combined with a single backing web is formed at a "wet end" of a production line. At a "dry end" of the production line, a second backing of web material is applied to the fluted web of the single face. The resulting corrugated cardboard comprises the fluted web of the single face material adhered between the single face backing and the second backing applied at the dry end.

Recent advances in "dry end" equipment have dramatically increased the speed and efficiency of dry end production. Despite these advances, however, production is still encumbered by inefficiencies in the "wet end" equipment. In particular, in order to change or replenish the supply of single face web material, the entire production line must be shut down while new material is manually installed into the system. Typically, material from one single face supply machine is manually removed from the system, and material from a second, adjacent single face supply machine is manually fed into the system. Once the second single face supply is installed, the entire line must be slowly accelerated to the steady state speed of production. Obviously, this time consuming process results in significant losses in production capacity, and eliminates the possibility of making efficient changes from one single face material type to another. Accordingly, there is a long felt need in the art for a single face splicing apparatus capable of automatically splicing single face web material to effect single face supply changes/replenishment without interrupting production.

OBJECTS OF THE INVENTION

Thus, it is an object of the present invention to provide a single face splicing apparatus which is capable of automatically splicing single face web material from separate single face supplies to provide an uninterrupted supply of single face to double backer systems.

It is another object of the present invention to provide a single face splicing apparatus which allows for pre-acceleration of a ready web to allow for high speed splicing of single face material.

Another object of the present invention to provide a single face splicing apparatus which is capable of automatically splicing single face web material from separate single face supplies and which is of a simple and cost efficient design.

These and other objects of the present invention will become apparent from a review of the description provided below.

SUMMARY OF THE INVENTION

The present invention is organized about the concept of providing a single face splicer which can provide a continuous supply of single face material to a double backer system. The splicer according to the invention creates a storage of single face material on an upper bridge supply belt, or exit conveyor, which is depleted by the double backer system as a splice is created between first and second sources of single face. In addition, the splicer allows for pre-acceleration of a ready web of single face material prior to initiation of a splice by creating storage of the ready web on one of two lower bridge supply belts, or exit conveyor, as the source of the ready web is pre-accelerated to a running speed.

Specifically, a single face splicer according to the invention creates a splice between a running web from a first source of single face material and a ready web from a second source of single face material. The splicer includes an upper, or exit, and lower, or entrance bridge positioned above the first and second sources of single face material, and a splice head adjacent the upper bridge for creating the splice between the running web and the ready web. A drive system draws the running web through the splice head at an output speed which is greater than a double backer speed at which the double backer system draws the running web from the splicer. An upper bridge supply belt, or exit conveyor, is rotatingly fixed to the upper bridge, and first and second lower bridge supply belts, or exit conveyors, are rotatingly fixed to the lower bridge adjacent the first and second supplies of single face material, respectively. In one embodiment, a pair of opposed single face input belts is provided adjacent each of the first and second single face supplies for carrying the running and ready webs onto the first and second lower bridge supply belts, respectively.

The drive system is adapted for depositing the running web onto the upper bridge supply belt at the output speed, and the upper bridge supply belt is adapted for rotation relative to the upper bridge at an upper bridge supply belt speed which is slower than the output speed. The difference in speed between the output speed, the upper bridge supply belt speed, and the double backer speed causes the running web to accumulate on the upper bridge supply belt. The accumulated running web provides an uninterrupted supply of single face material to the double backer system as the splice is created.

To allow for pre-acceleration of the first source of single face material prior to the running web being drawn through the splice head, the first lower bridge supply belt is adapted to receive the running web at a first input speed from the first source, and is adapted for rotation relative to the lower bridge at a first lower bridge supply belt speed which is slower than the first input speed. The difference between the first lower bridge supply belt speed and the first input speed causes the running web to accumulate on the first lower bridge supply belt. Likewise, the second lower bridge supply belt is adapted to receive the ready web at a second input speed from the second source of single face material. The second lower bridge supply belt is adapted for rotation relative to the lower bridge at a second lower bridge supply belt speed which is slower than the second input speed. The difference between the second lower bridge supply belt speed and the second input speed causes the ready web to accumulate on the second lower bridge supply belt to allow for pre-acceleration of the second source of single face material prior to initiation of the splice.

BRIEF DESCRIPTION OF THE DRAWING

A preferred embodiment of the invention is described below with reference to the following figures wherein like numerals represent like parts.

DETAILED DESCRIPTION OF THE INVENTION

Figure 1:
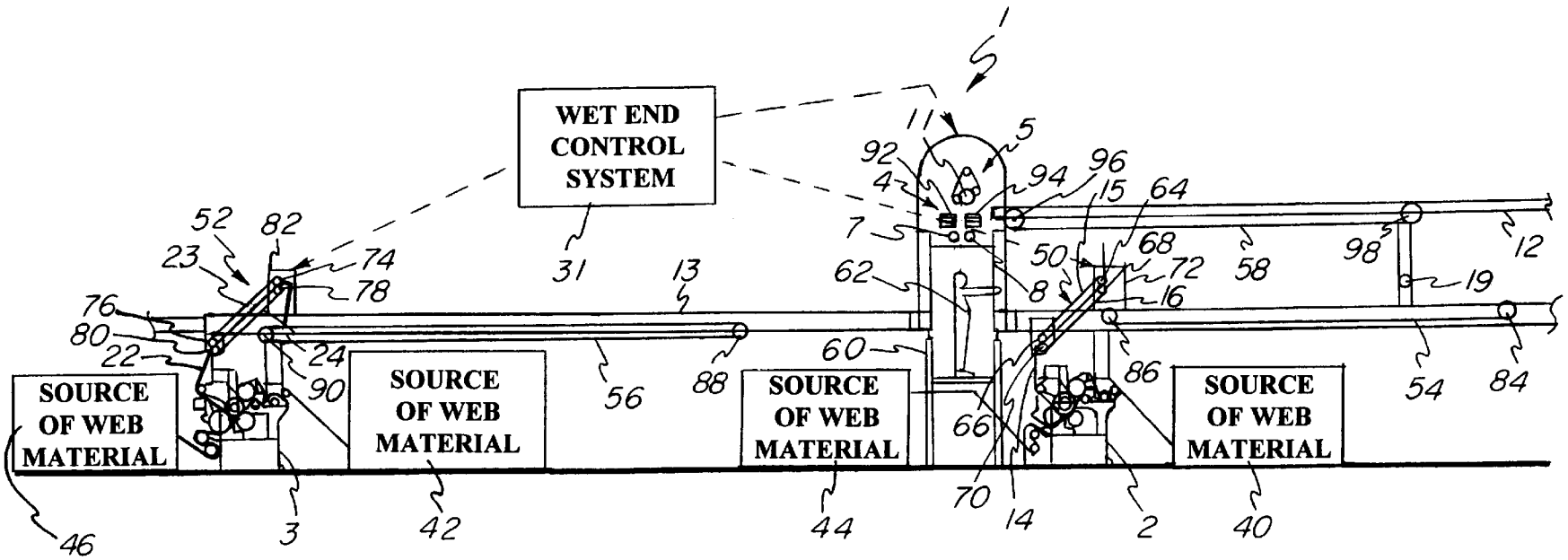
FIG. 1: is a front sectional view of a preferred embodiment of a single face splicer according to the present invention.

With reference now to FIG. 1 of the drawings, there is shown a single face splicer 1 according to the invention. The splicer 1 creates a splice between a running web 14 of single face material drawn from a first supply of single face material, e.g. first or front single facer 2, and a ready web 22 of single face material from a second supply of single face material, e.g. second or rear single facer 3. As is known, the single face material comprises a fluted web with a single backing adhered thereto. The single face material is combined with a second backing of web material at a "dry end" (not shown) of the production line by a "double backer" to form corrugated cardboard. The resulting corrugated cardboard, comprises the fluted web of the single face material adhered between the single face backing and the second backing applied at the dry end.

The front and rear single facers produce the single face webs 14, 22 in a known manner from first 40,42 and second 44,46 sources of web material provided to each single facer. The web material is preferably provided on known roll stands (not shown) to facilitate replenishing of the web material. Those skilled in the art will, however, recognize that many variations of single facers and web sources are possible.

Above the single facers are the major components of the single face splicer 1: a first pair 50 of opposed single face input conveyors, preferably belts 15,16, a second pair 52 of opposed single face conveyors, preferably belts 23, 24, a lower, or entrance bridge 13 with first and second entrance conveyors, preferably lower bridge supply belts 54 and 56, a splice head 4, a torque controlled single face drive system 5, and an upper, or exit, bridge 12 with an exit conveyor, preferably an upper bridge supply belt 58. As will be appreciated from the following description of the preferred embodiment, the lower and upper bridges 13 and 12 provide entrance and exit web storage regions for receiving and accumulating the ready and running webs 22 and 14, respectively. In the embodiment shown, an operator stand 60 is provided to allow convenient access to the splice head 4 by an operator 62 for splice preparation. The operator stand could be adjusted or removed, however, depending on the mechanism used for splice preparation.

The first pair 50 of opposed single face input belts includes an upper belt 15 and a lower belt 16 trained around wheels 64,66 and 68,70, respectively. Each belt is trained around a idle wheel 66,70 and a drive wheel 64, 68 which is driven by a first torque controlled entrance conveyor drive system 72 for establishing controlled motion of the belts over the wheels. The belts are positioned such that a bottom surface of the upper belt 15 is in contact with an upper surface of the lower belt 16 as the belts travel over the wheels. The second pair 52 of opposed single face input belts is constructed in an identical manner with the upper 23 and lower 24 belts positioned over wheels 74,76 and 78,80, respectively. A second torque controlled entrance conveyor drive system 82 drives the drive wheels 74,78 at a controllable rate.

The drive wheels 64,68 and 74,78, respectively, of the first and second pairs of opposed single face input belts are positioned above the first and second lower bridge supply belts, and the idle wheels 66,70 and 76, 80 are positioned adjacent the respective single facers 2,3. In operation, each pair of opposed single face input belts receives single face material from a single facer between the opposed belts and carries the material upward in the direction of the drive wheels. It is to be understood, however, that although pairs of opposed single face input belts are used in the preferred embodiment, it is also possible to use other systems, e.g. a single belt or a single roll, for carrying the single face to the supply belts.

In the preferred embodiment, the single face material is carried through the single face input belts and falls on a corresponding first 54 or second 56 lower bridge supply belt. Each lower bridge supply belt 54,56 is positioned below the drive wheels of corresponding pairs of opposed single face input belts on a drive wheel 86,90 and an idle wheel 84,88 to be rotatingly fixed to the lower bridge. The drive wheel 86 for the first lower bridge supply belt 54 and the drive wheel 90 for the second lower bridge supply belt 56 are driven by the known first and second torque controlled entrance conveyor drive systems 72,82, respectively, for establishing controlled motion of the supply belts 54,56 over the wheels 86,84 and 90,88. In operation, the supply belts travel over the wheels 86,84 and 90,88 at a speed which is slower than the rate at which the single face is sourced through the pair of single face input belts 50,52 from the single facers. As will be described in detail below, the single face material thus accumulates in ribbons on the lower bridge supply belts 54,56, allowing for pre-acceleration of the single face supplies 2,3 prior to the initiation of a splice.

From the lower bridge supply belts 54,56, single face material is adapted to be trained into the splice head 4. In the embodiment shown, the single face web 14 from the front single facer 2 travels into the splice head 4 by passing over a first idler roll 19 and under a second idler roll 8. The single face web 22 from the rear single facer 3 travels under a single idler roll 7 and into the splice head 4. This arrangement is provided to ensure that approximately equal amounts of single face web storage exists between the splice head 4 and the single facers 2,3. As will be apparent to those skilled in the art, the positioning of the single facers 2,3 may vary depending upon the space requirements for the splicer 4. Corresponding changes in the positioning and number of idler rolls between the single facers 2,3 and the splice head 4 would be necessary to ensure that sufficient web storage exists between the splice head 4 and the single facers 2,3.

The splice head 4 is a known system wherein two or more nip rolls (not shown) are driven together to make a splice. Knives (not shown) extending from an opposed pair of knife blocks 92,94 are provided to sever single face web 14 or 22 from the front 2 and rear single facer 3. Preparation of the leading edge of a single face web for a splice may be performed in a number of ways, as is known by those skilled in the art. Preferably, however, the splice is prepared by securing the leading edge of the single face web to the splice head 4 adjacent the running web using double backed tape. Upon initiation of the splice, the tape adheres the leading edge of the ready web to the running web, and the running web is severed by a splice head knife. The ready web then becomes the new running web.

Throughout the operation of the splicer 1, a known torque controlled single face drive system 5 draws single face material through the splice head and deposits it on the upper bridge supply belt 58. The drive system 5 generally comprises a known torque controlled driven speed control 11 which controls the speed of the single face web between the upper 12 and lower bridge 13. Examples of a splice head and a torque controlled driven speed control, along with a description of a splice preparation mechanism and process are disclosed in Applicant's U.S. Pat. No. 5,679,195, the teachings of which are incorporated herein by reference. It will be readily apparent to those skilled in the art, however, that the present invention can be used in connection with many types of known splice heads, splice preparation systems, and torque controlled driven speed controls.

As the single face material is drawn through the splice head by the drive system 5, it falls onto the upper bridge supply belt 58. The upper bridge supply belt 58 is rotatingly fixed to the upper bridge 12 on a drive wheel 96 and an idle wheel 98, and is driven by an exit conveyor drive system, preferably the torque controlled drive system 5 for establishing controlled motion of the upper bridge supply belt 58 over the wheels 96 and 98. In operation, the upper bridge supply belt travels over the wheels 96 and 98 at a speed which is slower than the rate at which the single face is drawn through the splice head 4 by the drive system 5. As will be described in detail below, the single face material thus accumulates in ribbons on the upper bridge supply belt 58. At the initiation of a splice, the accumulated single face on the upper bridge 12 provides an uninterrupted supply of single face to the double backer systems.

The entire splicing process is controlled by a wet end control system 31. The wet end control system 31 incorporates a suitable computer for controlling the drive system 5 and the drive systems for the opposed pairs of single face input belts and the lower bridge supply belts to maintain a proper speed relationship between these systems and the double backer. The wet end control system 31 also calculates and controls the amount of single face accumulation/storage on each bridge section in dependence upon the double backer speed.

Figure 2:
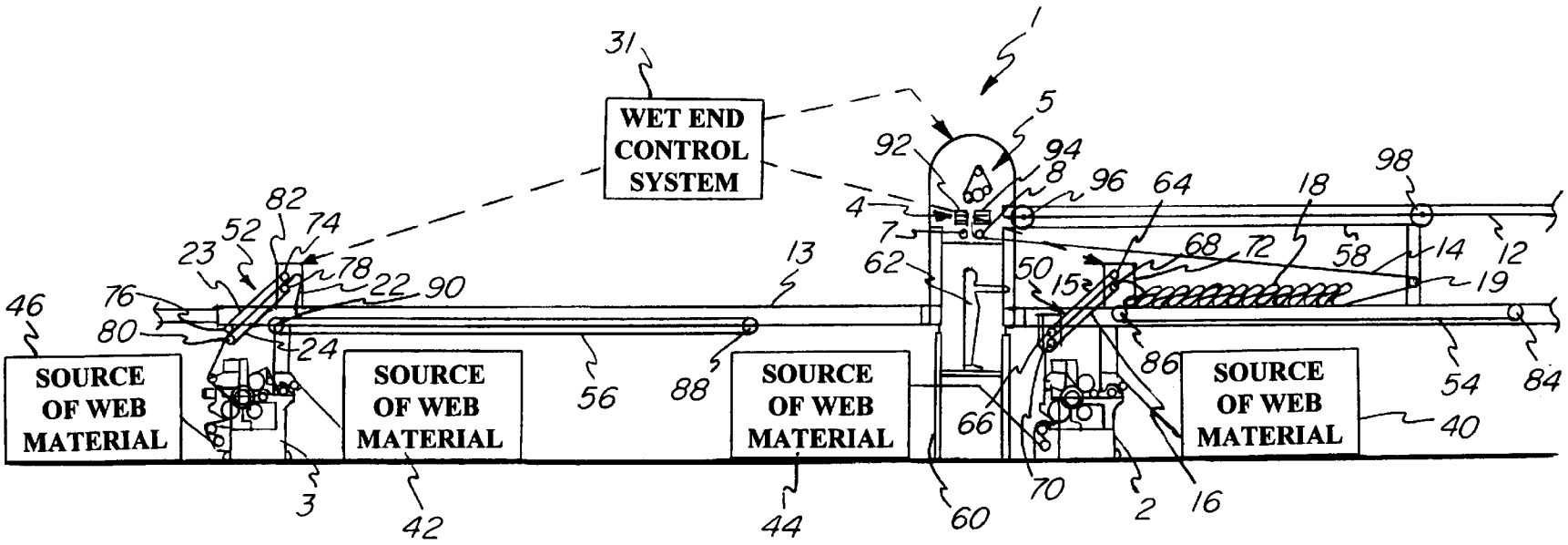
FIG. 2: is a front sectional view of the embodiment of FIG. 1, showing the threading of a front single face supply through the opposed single face input belts, the splice head, and the torque controlled single face drive system and the accumulation of single face web on a lower bridge supply belt.

Turning now to FIGS. 2–7, there is shown the single face splicer 1 of FIG. 1, in successive stages of a splicing operation. As shown in FIG. 2, in the start up and running of the front single facer 2, the single facer 2 is started and the single face web 14 is trained between the first pair 50 of opposed single face supply belts 15,16. Belts 15,16 carry the leading edge of the single face web 14 into the lower bridge 13 and onto the first lower bridge supply belt 54. The drive wheel 86 of the belt 54 drives the belt at a slower speed than the front single facer 2 which is accelerated to the speed of the double backer system. Single face web 14 is thereby caused to accumulate into ribbons 18 on the lower bridge supply belt 54. At this point, an operator inspects the single face accumulated on the lower bridge supply belt 54 and removes any damaged sections thereof. The single face web 14 is then pulled around a first idler roll 19, which is located close to centering guides for the ribbons 18, and then under the roll 8. From the roll 8, the single face web 14 is trained through the splice head 4 and around the speed control 11.

Figure 3:
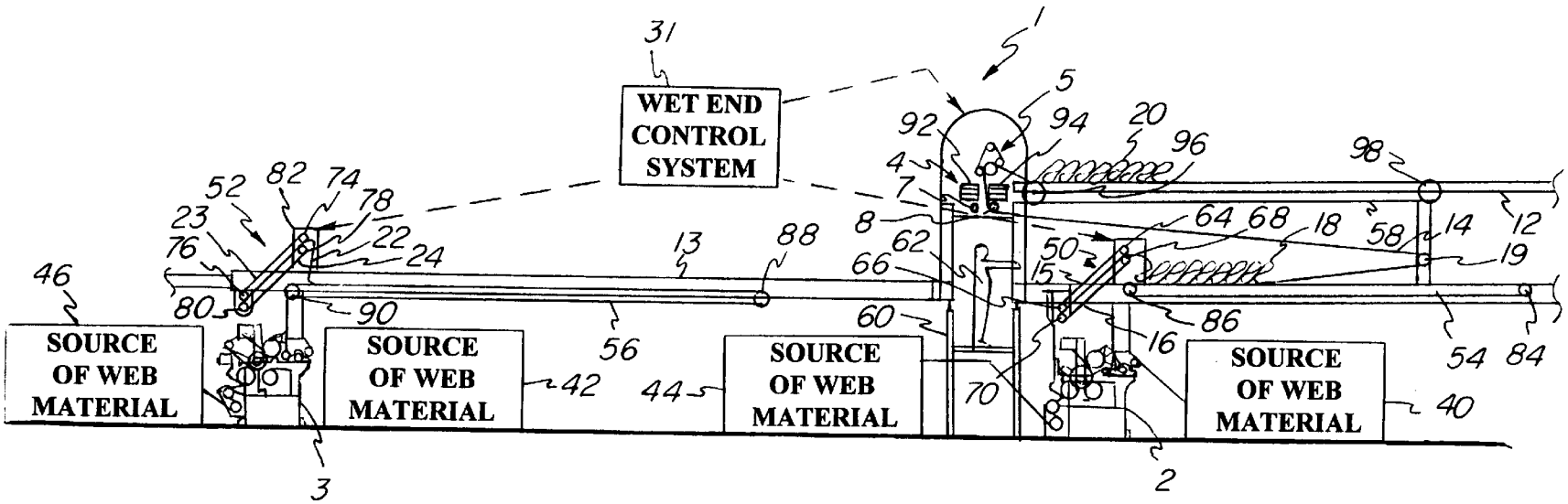
FIG. 3: is a front sectional view as of the embodiment of FIG. 1 showing the transfer of accumulated single face web from a lower bridge supply belt to and upper bridge supply belt.

Turning to FIG. 3, the single face web 14 exits the speed control 11 onto the upper bridge supply belt 58 through centering guides (not shown). When the dry end or "double backer" systems (not shown) begin to run and draw material from the single face splicer apparatus, the speed control 11 increases speed above the double backer speed and depletes the accumulated ribbons or loops 18 of single face 14 on the lower bridge supply belt 54. This difference in speed between the speed control 11 and the double backer, which is drawing material from the apparatus, causes the single face to accumulate in storage loops or ribbons 20 on the upper bridge supply belt 58 which is driven at a speed slower than the double backer.

Figure 4:
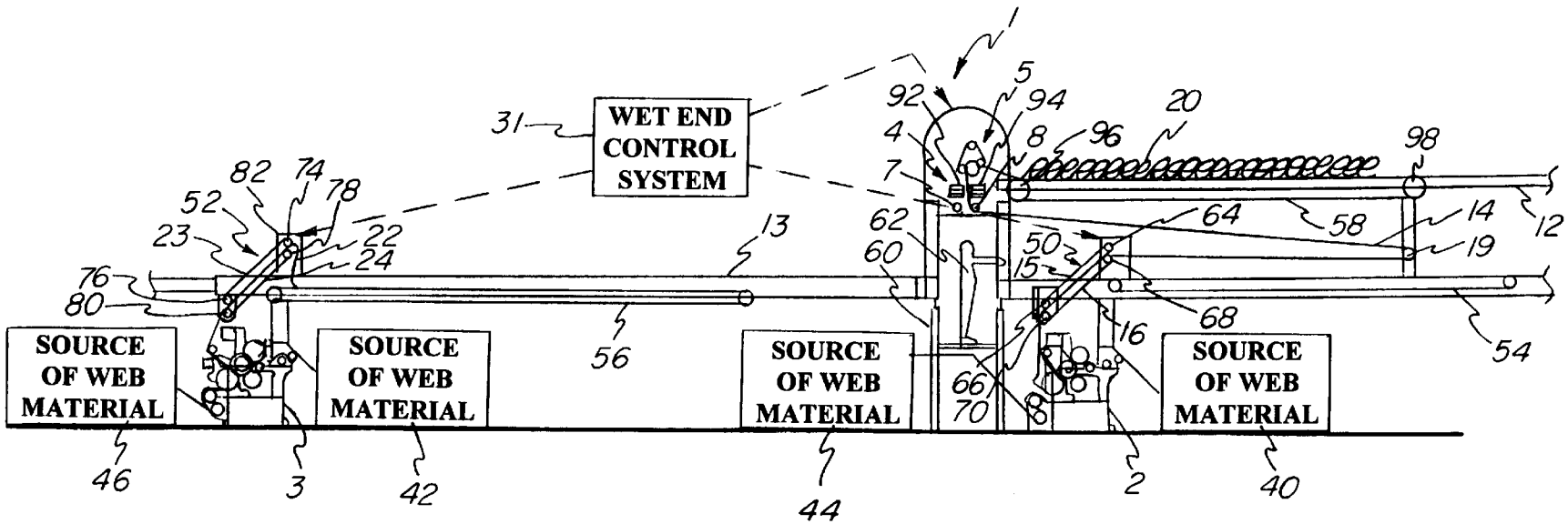
FIG. 4: is a front sectional view of the embodiment of FIG. 1 showing the accumulated single face web transferred to the upper bridge and a tight running web established between the splice head and the front single face supply in a steady state operating condition.

As shown in FIG. 4, the speed control 11 continues to draw single face material from the lower bridge supply belt 54 to deplete the accumulated ribboned single face 18. Once the ribboned single face 18 is depleted, the speed control 11 draws material directly from the front single facer through the belts 15, 16 to maintain a tight running web 14 between the front single facer 2 and the speed control 11 while the system is running and supplying single face to the double backer systems.

Figure 5:
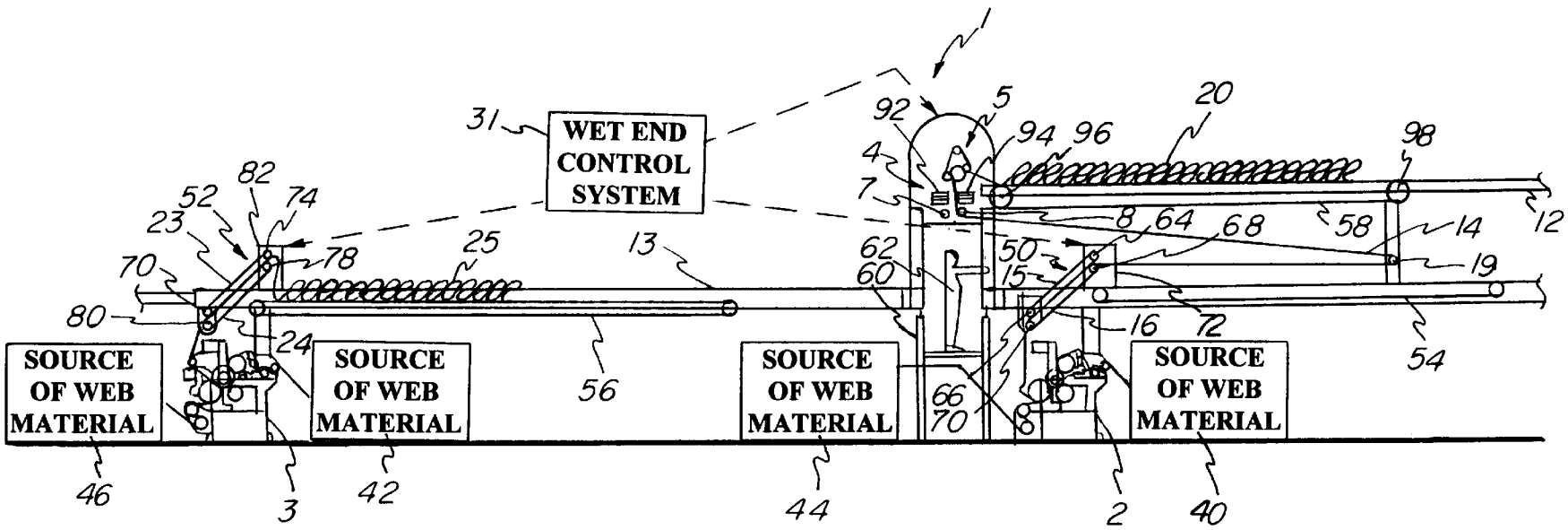
FIG. 5: is a front sectional view of the embodiment of FIG. 1 showing the running web from the front single face supply in a steady state condition, the threading of single face web from a rear single face through a pair of opposes single face input belts, and the accumulation of the rear single face web on the lower bridge supply belt.
Figure 6:
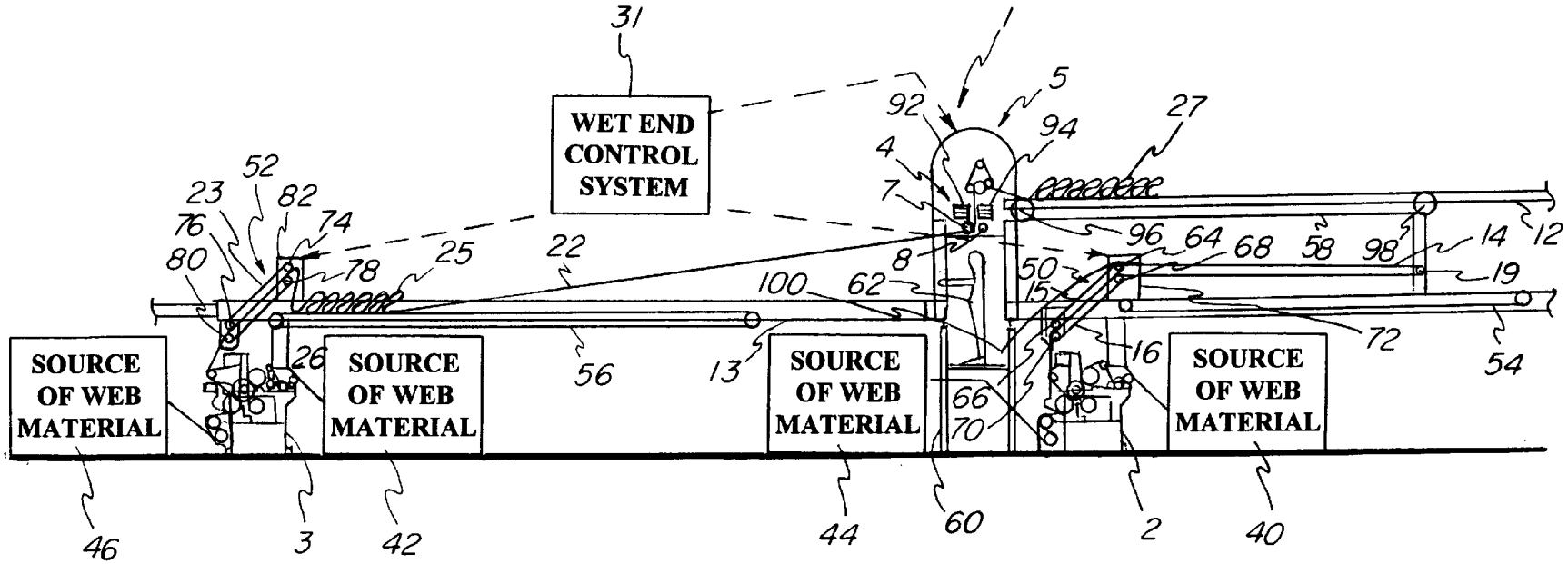
FIG. 6: is a front sectional view of the embodiment of FIG. 1 showing accumulated single face web from the rear single face on a lower bridge supply belt being transferred to the upper bridge supply belt after a splice, and showing the severed single face web from the front single face.

Referring now to FIGS. 5 and 6, in order to change the single face supply to the rear single facer 3, the rear single facer 3 is started and the leading edge of the single face web 22 is trained between the second pair opposed single face input belts 52. As above, the belts 23, 24 carry the single face web 22 onto the second lower bridge supply belt 56 which is running at a slower speed than the speed at which the single face is being supplied by the rear single facer 3. Advantageously, therefore, the single face web 22 accumulates in ribbons 25 on the lower bridge supply belt 56, allowing pre-acceleration of the rear single facer 3 to operating speed prior to the initiation of a splice. Also, the operator can inspect the accumulated single face web, and remove any damaged material.

The leading edge of the single face web 22 from the rear single facer 3 is then trained around the idler roll 7 and is appropriately positioned in the splice head 4 for a splice. At the initiation of a splice, the front single facer 2 is stopped, and then the speed control 11 is stopped. The double backer at the dry end draws single face web 14 from the accumulated ribbons 20 on the upper bridge 12. The rear single facer 3 is then pre-accelerated to a running speed, i.e. the speed of the double backer.

When single face web 14 from the front single facer 2 reaches zero web speed through the splice head 4, the splice head is activated to form a splice joint between the running single face web 14 and the ready single face web 22 from the rear single facer 3. A splice head knife then severs the single face web 14 allowing the leading edge 100 of the web 14 to drop out of the splice head 4. The ready web 22 then becomes the new running web.

The speed control 11 is accelerated to a level above the double backer speed. The rear single facer 3 then matches the double backer speed, and the accumulated single face 25 on the lower bridge supply belt 56 is transferred to the upper bridge supply belt 58. Ribbons or loops 27 of accumulated rear single face web 22 are then accumulated on the upper bridge supply belt 58.

Figure 7:
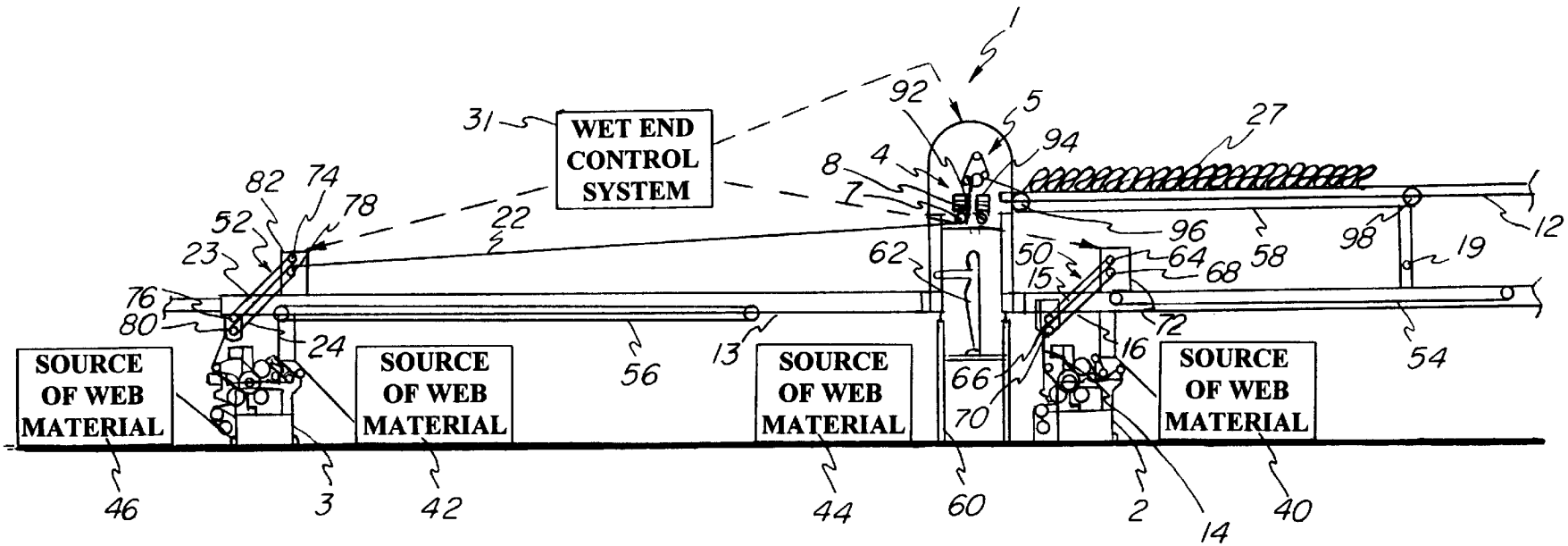
FIG. 7: is a front sectional view of the embodiment of FIG. 1 showing the accumulated single face web transferred to the upper bridge and a tight running web established between the splice head and the rear single face supply in a steady state operating condition.

As shown in FIG. 7, the speed control 11 continues to draw single face material from the lower bridge supply belt 56 to deplete the accumulated ribboned single face 25. Once the ribboned single face is depleted, the speed control draws material directly from the rear single facer 3 through the belts 23, 24 to maintain a tight web 22 between the rear single facer 3 and the speed control 11 while the system is running.

Upon completion of the splicing operation, a lead of front single face web 14 remains between the front single facer 2 and the splice head 4. The operator can accumulate the waste single face left on the bridge which must be discarded prior to the preparation for the next splice from the front single facer.

As will be apparent to those skilled in the art, since the double backer speed can run from 0–1000 F.P.M., the amount of single face storage on the upper and lower bridge supply belts depends on the speed of the double backer and the speed of the splicing operation. Generally, however, sufficient storage on the upper bridge supply belt must be established to allow a continuous supply of single face to the double backer during the splicing operation, i.e. from the time the running web is stopped to the time that a new web is accelerated by the speed control to a speed above the speed of the double backer. Likewise, sufficient storage on the lower bridge supply belts must be established to allow pre-acceleration of the single facers to the speed of the double backer systems prior to the completion of a splice.

It has been found that sufficient storage can be achieved by setting the speed of the upper 58 and lower 54, 56 bridge supply belts at about one-third of the speed of the double backer systems. This results in an average of about 120 feet of ribboned or looped single facer storage on the supply belts. To accommodate this amount of storage, the upper and lower bridge supply belts are preferably about 20 feet in length.

Thus, according to the present invention there is provided single face splicer which is capable of reliably effecting a high speed splice between two single face supplies without interrupting production. The apparatus performs this function using accumulation of single face web in lower and upper bridges to allow for pre-acceleration of the new single face to a running speed prior to completion of a splice and to provide an uninterrupted supply of single face material to the double backer. The embodiments which have been described herein, however, are but some of the several which utilize this invention and are set forth here by way of illustration but not of limitation. It is obvious that many other embodiments which will be readily apparent to those skilled in the art may be made without departing materially from the spirit and scope of this invention.

What is claimed is:

1. A single face splicer for supplying a running web of single face material to a double backer system said splicer comprising:

first and second sources of single face material, said first source providing said running web of single face material and said second source providing a ready web of single face material, said single face material including a fluted web and a backing adhered to said fluted web;

an exit bridge positioned downstream from said first and second sources of single face material for accumulating said running web;

a splice head positioned intermediate said exit bridge and said first and second sources of single face material for creating a splice between said running web of single face material and said ready web of single face material;

a drive system for drawing said running web through said splice head at an output speed which is greater than a double backer speed at which the double backer system draws said running web from said splicer;

an exit conveyor operably connected to said exit bridge, wherein said drive system is adapted for depositing said running web onto said exit conveyor at said output speed, and wherein said exit conveyor is adapted for movement relative to said exit bridge at an exit conveyor speed which is slower than said output speed to cause said running web to accumulate on said exit conveyor to provide an uninterrupted supply of said running web to the double backer system as said splice is created; and an entrance bride positioned intermediate said exit bridge and said second source of single face material for accumulating said ready web.

2. A single face splicer according to claim 1, wherein said exit conveyor speed is about one-third of said double backer speed for accumulating said running web in storage loops on said exit conveyor.

3. A single face splicer according to claim 1, wherein said exit conveyor has a length of about twenty feet.

4. A single face splicer according to claim 1 further comprising:

an entrance conveyor operably connected to said entrance bridge adjacent said second source of single face material;

wherein said entrance conveyor is adapted to receive said ready web at an in input speed from said second source of single face material, and wherein said entrance conveyor is adapted for movement relative to said entrance bridge at an entrance conveyor speed which is slower than said input speed to thereby cause said ready web to accumulate on said entrance conveyor to allow for pre-acceleration of said second source of single face material prior to initiation of said splice.

5. A single face splicer according to claim 4 further comprising a pair of opposed single face input belts positioned intermediate said second source of single face material and said entrance conveyor, and wherein said ready web is carried onto said entrance conveyor between said pair of opposed single face input belts.

6. A single face splicer according to claim 4, wherein said entrance conveyor speed is about one-third of said double backer speed for accumulating said ready webs in storage loops on said entrance conveyor.

7. A single face splicer according to claim 4, wherein said entrance conveyor has a length of about twenty feet.

8. A single face splicer according to claim 1, said splicer further comprising:

a first entrance conveyor operably connected to said entrance bridge adjacent said first source of single face material; and a second entrance conveyor operably connected to said entrance bridge adjacent said second source of single face material, wherein said first entrance conveyor is adapted to receive said running web at a first input speed from said first source of single face material, and wherein said first entrance conveyor is adapted for movement relative to said entrance bridge at a first entrance conveyor speed which is slower than said first input speed to thereby cause said running web to accumulate on said first entrance conveyor to allow for pre-acceleration of said first source of single face material prior to drawing of said running web through said splice head by said drive system, and wherein said second entrance conveyor is adapted to receive said ready web at a second input speed from said second source of single face material, and wherein said second entrance conveyor is adapted for movement relative to said entrance bridge at a second entrance conveyor speed which is slower than said second input speed to thereby cause said ready web to accumulate on said second entrance conveyor to allow for pre-acceleration of said second source of single face material prior to initiation of said splice.

9. A single face splicer according to claim 8 further comprising a first pair of single face input belts positioned intermediate said first source of single face material and said first entrance conveyor, a second pair of single face input belts positioned intermediate said second source of single face material and said second entrance conveyor, and wherein said running web is carried onto said first entrance conveyor between said first pair of opposed single face input belts, and said ready web is carried onto said second entrance conveyor between said second pair of opposed single face input belts.

10. A single face splicer according to claim 8, wherein said first and second entrance conveyor speeds are about one-third of said double backer speed for accumulating said running and ready webs in storage loops on said first and second entrance conveyors.

11. A single face splicer according to claim 8, wherein said first and second entrance conveyors have lengths of about twenty feet.

12. A method of supplying single face material to a double backer system comprising:

providing a single face splicer, said splicer comprising:

first and second sources of single face material, said first source providing a running web of single face material and said second source providing a ready web of single face material, said single face material including a fluted web and a backing adhered to said fluted web;

an entrance bridge and an exit bridge positioned downstream from said first and second sources of single face material, said entrance bridge positioned intermediate said exit bridge and said second source of single face material;

a splice head intermediate said exit bridge and said first and second sources of single face material for creating a splice between said running web and said ready web;

a drive system for drawing said running web through said splice head at an output speed which is greater than a double backer speed at which the double backer system draws said running web from said splicer;

an entrance conveyor operably connected to said entrance bridge adjacent said second source of single face material; and an exit conveyor operably connected to said exit bridge, wherein said entrance conveyor is adapted to receive said ready web at an input speed from said second source of single face material, and wherein said entrance conveyor is adapted for movement relative to said entrance bridge at an entrance conveyor speed which is slower than said input speed to thereby cause said ready web to accumulate on said entrance conveyor to allow for pre-acceleration of said second source of single face material prior to initiation of said splice, and wherein said drive system is adapted for depositing said running web onto said exit conveyor at said output speed, and wherein said exit conveyor is adapted for movement relative to said exit bridge at an exit conveyor speed which is slower than said output speed to cause said running web to accumulate on said exit conveyor to provide an uninterrupted supply of said running web to the double backer system as said splice is created;

moving said exit conveyor at said exit conveyor speed;

operating said drive system to deposit said running web onto said exit conveyor thereby causing accumulation of said running web on said exit conveyor, said accumulation providing an uninterrupted supply of said running web as said splice is created;

moving said entrance conveyor at said entrance conveyor speed;

pre-accelerating said second source of single face material to supply said ready web onto said entrance conveyor prior to initiation of said splice; and initiating said splice when said first source of single face material is nearly exhausted, whereby after said splice is created said second source of single face material provides said running web and said first source of said single face material provides said ready web.

13. A method according to claim 12, wherein said splicer further comprises a pair of opposed single face input belts positioned intermediate said second source of single face material and said entrance conveyor, and wherein said ready web is supplied onto said entrance conveyor between said pair of opposed single face input belts.

14. A method according to claim 12, wherein said exit conveyor speed is about one-third of said double backer speed.

15. A method according to claim 12, wherein said entrance conveyor speed is about one-third of said double backer speed.

16. A single face splicer for supplying a web of single face material to a double backer, said splicer comprising:

a first source of single face material providing a running web of single face material;

a second source of single face material positioned in spaced relation to said first source of single face material and providing a ready web of single face material;

said single face material including a fluted web and a backing adhered to said fluted web;

a splice head positioned downstream from said first and second sources of single face material for creating a splice between said running web of a single face material and said ready web of a single face material;

an entrance web storage region for receiving and accumulating said ready web, said entrance web storage region positioned intermediate said second source of single face material and said splice head; and an exit web storage region for receiving and accumulating said running web, said exit web storage region positioned downstream from said splice head.

17. The single face splicer according to claim 16 wherein said entrance web storage region includes:

an entrance bridge;

an entrance conveyor supported for movement relative to said entrance bridge; and an entrance conveyor drive system operably connected to said entrance conveyor for driving said entrance conveyor in motion.

18. The single face splicer according to claim 17 wherein said exit web storage region includes:

an exit bridge;

an exit conveyor supported for movement relative to said exit bridge; and an exit conveyor drive system operably connected to said exit conveyor for driving said exit conveyor in motion.

19. The single face splicer according to claim 18 further comprising an input conveyor positioned intermediate said second source of single face material and said entrance conveyor, wherein said ready web is carried onto said entrance conveyor by said input conveyor.

20. The single face splicer according to claim 19 further comprising a wet end control system in communication with said entrance and exit conveyor drive systems for controlling motion of said entrance and exit conveyors thereby controlling accumulation of said ready web on said entrance conveyor and controlling accumulation of said running web on said exit conveyor.

21. The single face splicer according to claim 20 further comprising a single face drive system for drawing said running web through said splice head at an output speed wherein said wet end control system is operably connected to said single face drive system for controlling said output speed.

22. The single face splicer according to claim 16 wherein said first and second sources of single face material comprise first and second single facers, each of said first and second single facers supplied by first and second sources of web material.

23. A single face splicer comprising:

a first source of single face material providing a running web of single face material;

a second source of single face material positioned in spaced relation to said first source of single face material and providing a ready web of single face material;

said single face material including a fluted web and a backing adhered to said fluted web;

a splice head positioned downstream from said first and second sources of single face material for creating a splice between said running web of a single face material and said ready web of a single face material;

a first entrance conveyor for receiving said running web, said first entrance conveyor positioned intermediate said first source of single face material and said splice head;

a first entrance conveyor drive system operably connected to said first entrance conveyor for driving said first entrance conveyor in motion;

a second entrance conveyor for receiving and accumulating said ready web, said second entrance conveyor positioned intermediate said second source of single face material and said splice head; and a second entrance conveyor drive system operably connected to said second entrance conveyor for driving said second entrance conveyor in motion.

24. The single face splicer according to claim 23 further comprising:

a first input conveyor positioned intermediate said first source of single face material and said first entrance conveyor, said first input conveyor driven in motion by said first entrance conveyor drive system;

a second input conveyor positioned intermediate said second source of single face material and said second entrance conveyor, said second input conveyor driven in motion by said second entrance conveyor drive system; and wherein said running web is carried onto said first entrance conveyor by said first input conveyors and said ready web is carried onto said second entrance conveyor by said second input conveyor.

25. The single facer according to claim 24 further comprising a wet end control system in communication with said first and second entrance conveyor drive systems for controlling motion of said first and second entrance conveyors and said first and second input conveyors thereby controlling accumulation of said running web on said first entrance conveyor and controlling accumulation of said ready web on said second entrance conveyor.

26. A method of supplying a continuous web of single face material, said method comprising the steps of:

providing a first source of single face material for supplying a running web of single face material;

providing a second source of single face material for supplying a ready web of single face material;

said single face material including a fluted web and a backing adhered to said fluted web;

providing a splice head downstream of said first and second sources of single face material for receiving said running and ready webs of single face material;

conveying said running web downstream through said splice head;

depositing said running web on an exit conveyor downstream from said splice head;

accumulating said running web on said exit conveyor;

forming a Splice between said running web and said ready web within said splice head;

pre-accelerating said second source of single face material;

depositing said ready web on an entrance conveyor upstream from said splice head;

accumulating said ready web on said entrance conveyor during said splicing step; and consuming at least some of said accumulated running web during said step of forming said splice, whereby after said splice is complete said second source of single face material provides said running web.

27. The method according to claim 26 further comprising the step of transferring said ready web accumulated on said entrance conveyor to said exit conveyor after said step of forming said splice.

28. The method according to claim 26 wherein said step of forming said splice comprises:

stopping said running web and said ready web within said splice head;

attaching said ready web to said running web within said splice head; and severing said running web, whereby said ready web becomes said running web.

* * * * *